United States Patent [19]

Thieme et al.

[11] 4,239,217

[45] Dec. 16, 1980

[54] TABLE TOP GOLF GAME APPARATUS

[76] Inventors: Omar M. Thieme; Ruby M. Thieme, both of 403 Vancil St., South Fulton, Tenn. 42041

[21] Appl. No.: 55,972

[22] Filed: Jul. 9, 1979

[51] Int. Cl.[3] ..... A63F 7/06

[52] U.S. Cl. ..... 273/87.4; 46/221

[58] Field of Search ..... 273/87.2, 87.4, 129 R; 46/221

[56] References Cited

U.S. PATENT DOCUMENTS

| | | | |
|---|---|---|---|
| 731,825 | 6/1903 | Voorhees | 273/87.4 |
| 750,134 | 1/1904 | Vaile | 273/87.4 |
| 2,513,198 | 6/1950 | Munro | 273/87.4 |
| 2,616,700 | 11/1952 | Munro | 273/87.4 |

FOREIGN PATENT DOCUMENTS

| | | | |
|---|---|---|---|
| 857182 | 12/1970 | Canada | 273/87.2 |

*Primary Examiner*—George J. Marlo
*Attorney, Agent, or Firm*—B. P. Fishburne, Jr.

[57] ABSTRACT

An indoor table game resembling golf employs a precision hand-operated playing apparatus including a wheeled maneuver unit, a connected actuator assembly, and an animate figure operated by the actuator assembly and holding interchangeable striking clubs for a lightweight game piece in the form of a ball. The game is preferably played on a game course embodied in a table-mounted movable strip. The feet of the inanimate figure are self leveling. A pair of spring-biased wheel fenders are provided to lock the wheeled unit in a fixed location on the playing course. The upper section of the inanimate figure may be driven as a right or left hand golfer and, in each case, the simulated head of the inanimate figure is driven to rotate in a natural follow-through mode. The game requires practice and skill in order to obtain proficiency.

26 Claims, 23 Drawing Figures

FIG 6
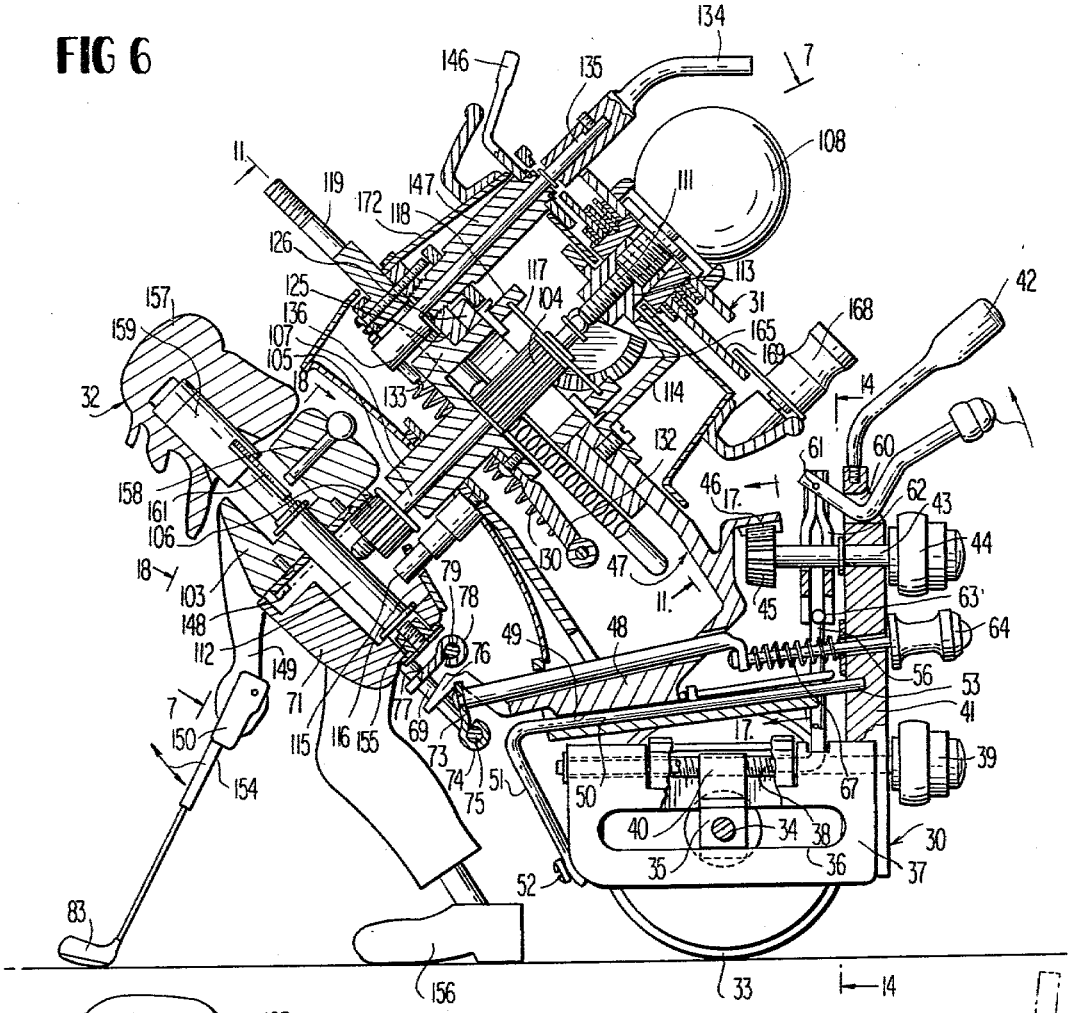
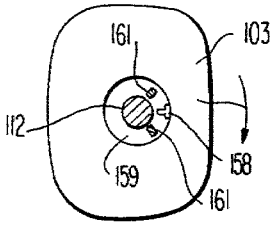
FIG 18A
FIG 11
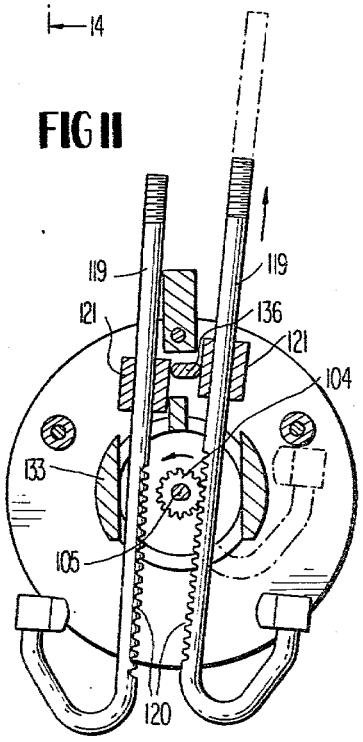
FIG 19
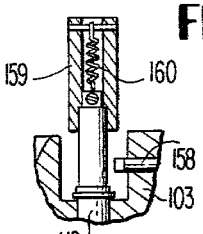
FIG 20
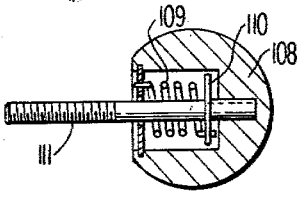
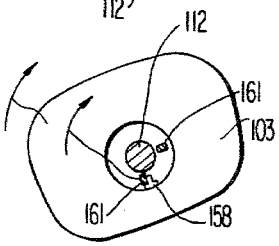
FIG 18B
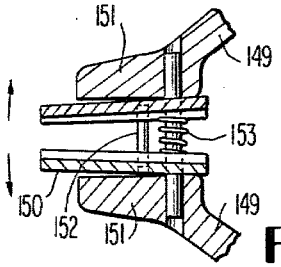
FIG 21

TABLE TOP GOLF GAME APPARATUS

BACKGROUND OF THE INVENTION

The invention has for its objective to provide an interesting and entertaining indoor table game of skill resembling golf and suitable for playing by adults or older children. One or more players can participate. The game apparatus was inspired by man's landing on the moon and the striking of a golf ball on the moon by an American astronaut.

Each player of the game utilizes a very lightweight game ball formed of Styrofoam or similar material, or a ball constructed like a pingpong ball but in smaller size. A playing course similar to a golf course is preferably contained on a driven strip or belt running on a level table of convenient height. The target areas on the strip resembling the greens and holes of a golf course can be identified, for example, as the nine planets of our solar system. A variety of hazards can be provided between each tee and green of the strip containing the course. Each advancement of the strip to a new position presents a new tee, fairway and green to the player or players. In lieu of the movable strip, the game may be played on a suitable table having a fixed playing course.

The heart of the game is embodied in a player manipulated apparatus which is precision built for efficiency of operation, comfort for the hand and wrist of the user, and to promote a delicacy of touch in acquiring the necessary skill for successful play. The player manipulated apparatus is not a toy but rather is a precision piece of equipment whose proper use in the playing of the game can be highly entertaining while requiring attention and concentration very similar to what is necessary in the actual game of golf. The playing apparatus is constructed for use by either right or left handed players.

Various features and advantages of the invention will become apparent during the course of the following detailed description.

SUMMARY OF THE INVENTION

A game playing apparatus utilized by each player of a table game resembling golf comprises a hand manipulated unit consisting of a wheeled comparatively massive maneuver assembly which is propelled over the game course during the playing of the game, an actuator assembly mounted bodily on the maneuvered assembly and traveling therewith, and an animate figure of golfer resembling a golfing astronaut detachably coupled to the maneuver assembly and having a driven connection with manually operated gearing of the actuator assembly.

The maneuver assembly includes a conveniently located propelling and steering handle for the entire player apparatus unit on the game course, such as a table-mounted game course strip having winding means. The maneuver assembly includes a yaw control knob for the actuator assembly and animate golfer relative to the maneuver assembly. A wheel brake control lever for fender brakes of the maneuver assembly is included thereon, together with an animate figure coupler operating knob and a fore and aft wheel adjustment knob. The maneuver assembly additionally carries on its opposite sides unique holders for a plurality of miniature realistic playing clubs and supply tanks for the featherweight game balls with ready dispensing means.

The actuator assembly, which comprises the heart of the player manipulated apparatus, includes right and left hand selective finger operators for the drive gearing of the actuator assembly in both power stroke and putting modes of operation. The actuator assembly has a lever to engage either the right or left hand finger operators and a yaw locking and visual indicator means. A control knob on the center of the actuator assembly regulates the tension of the finger operators and the tilt of the golfing figure.

The golfing figure possesses quick change club gripping clamps or jaws which simulate hands so that the various provided ball striking clubs may be conveniently employed by the players. The figure is equipped with realistic self-leveling feet and a torso or mid-section which is gear driven through the finger operators of the actuator assembly so that the figure will swing the clubs in a very realistic manner and under controllable power for driving and putting. A very realistic follow through mechanism is provided on the figure to impart to the head of the figure a true follow through movement within prescribed limits.

While the playing apparatus units are quite sophisticated, they are simple to operate and after a little practice time, the players of the game can acquire a high degree of skill in driving the lightweight ball and with putting. The game possesses realism, is very interesting and entertaining, and also competitive in the sense of testing one's skill against the skill of another.

BRIEF DESCRIPTION OF THE DRAWINGS

FIG. 6 is a central vertical section taken through the apparatus unit.

FIG. 11 is a cross sectional view, similar to FIG. 10, taken on line 11—11 of FIG. 6.

FIG. 18A is a fragmentary section taken on line 18—18 of FIG. 6 with the power driven portion of the golfing figure in a neutral position.

FIG. 18B is a similar view taken on line 18—18 of FIG. 6 with the power driven figure portion in a ball striking position.

FIG. 19 is a fragmentary vertical section showing a head follow through mechanism.

FIG. 20 is a fragmentary horizontal section taken through a finger operator tension control and golfing figure tilt control knob.

FIG. 21 is an enlarged fragmentary section taken on line 21—21 of FIG. 1.

DETAILED DESCRIPTION

Figure 1:
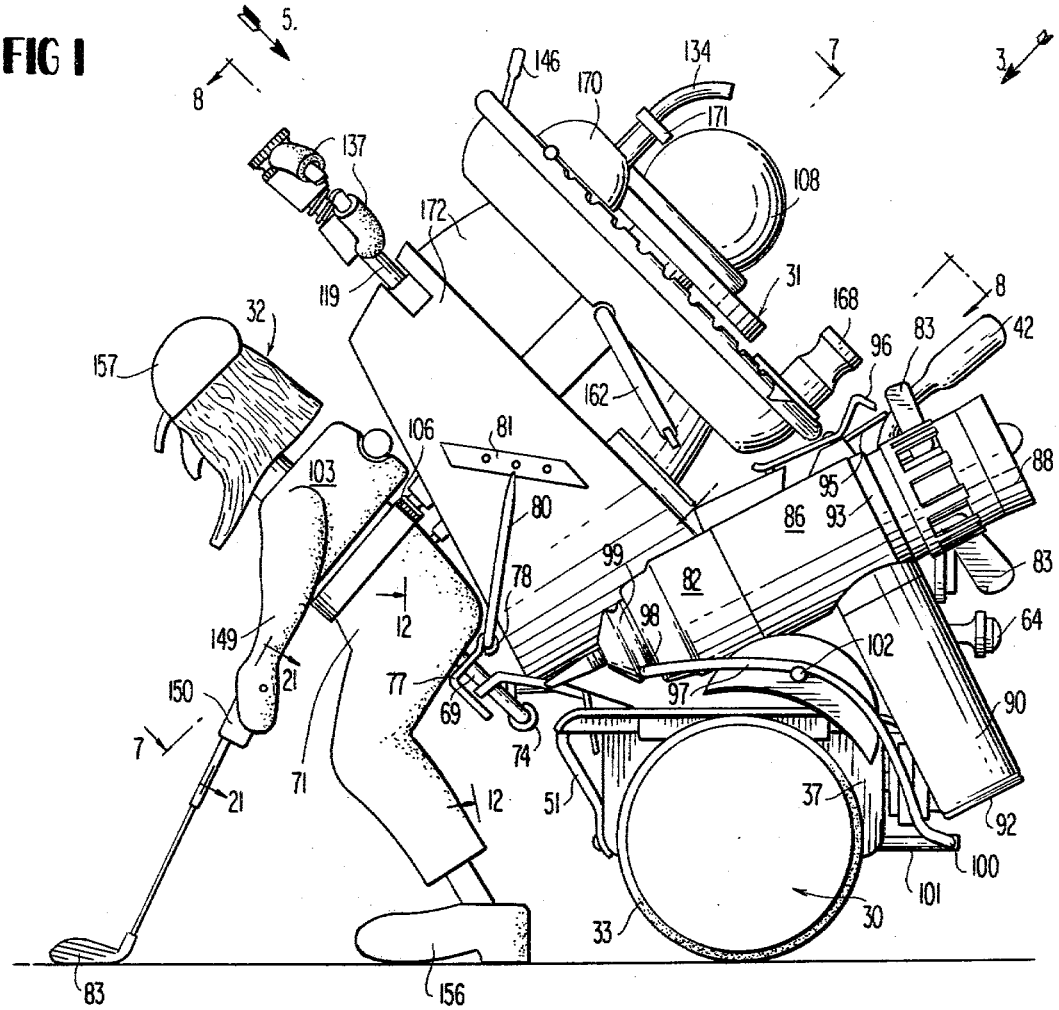
FIG. 1 is a side elevation of a playing apparatus unit included in the invention.

Referring to the drawings in detail, wherein like numerals designate like parts, a player operated mobile apparatus unit comprises a wheeled maneuver assembly 30, an actuator assembly 31 mounted thereon, and a golfing figure 32 preferably simulating an astronaut releasably coupled to the maneuver assembly 30 and having a driven connection with the actuator assembly 31.

For the sake of stability, the maneuver assembly 30 is massive compared to the other components of the apparatus unit and includes wide maneuver wheels 33 on a transverse axle 34 held in a bearing block 35 which has fore and aft sliding engagement in elongated slots 36 of a comparatively heavy frame 37 for the maneuver assembly 30. The position of the wheels 33 is adjustable force and aft on the frame 37 by an adjusting screw shaft 38 having a rear operating knob 39 and having threaded engagement with a center elevated portion 40 of bearing block 35. Through this adjustment, the balance, stability and the operational "feel" of the entire player manipulated unit can be finely regulated to suit the requirements of different individuals.

A heavy center post 41 or member rises above the frame 37 in fixed relation thereto and, at its top, supports an upwardly inclined main maneuver handle 42 rigid therewith. The maneuver handle extends well above the vertical center of the entire apparatus unit, FIG. 6, and somewhat rearwardly of the post 41 of maneuver assembly 30.

The maneuver assembly 30, near the top of the post 41 and below the handle 42, mounts a horizontal longitudinal yaw adjusting shaft 43 for the actuator assembly 31 and figure 32. The rotary shaft 43 has a rear end manual turning knob 44 and a forward end drive gear 45 meshing with an overlying gear segment 46 on the main frame 47 of actuator assembly 31. The base portion 48 of main frame 47 has a longitudinal somewhat inclined bore 49 receiving a fore-to-aft fixed shaft 50 having a forward end downturned extension 51 fixed at 52 to the front of frame 37 and having a rear terminal 53 anchored to the post 41. The fixed shaft 50 rockably supports the frame 47 of actuator assembly 31 so that the entire assembly 31 can be tilted laterally to either side of the axis of the shaft 50 which is located at the transverse center of the apparatus. Such lateral tilting or yaw adjustment of the assembly 31 and figure 32 on the maneuver assembly 30 is under control of the yaw adjustment knob 44 and its shaft 43 and drive gear 45.

Figure 14:
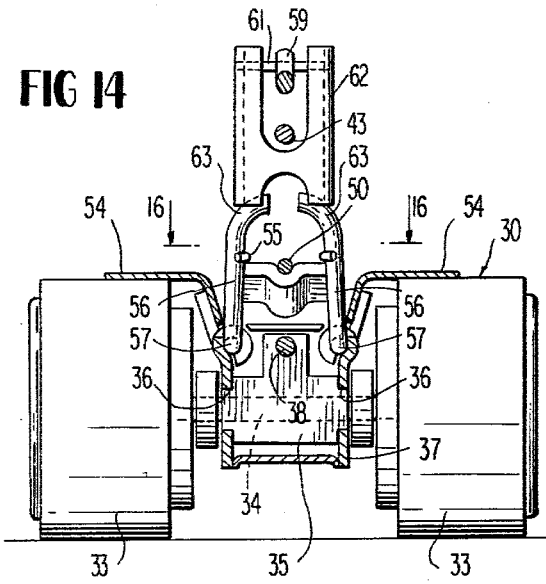
FIG. 14 is a vertical section taken on line 14—14 of FIG. 6 and showing a fender brake means actively engaged.
Figure 15:
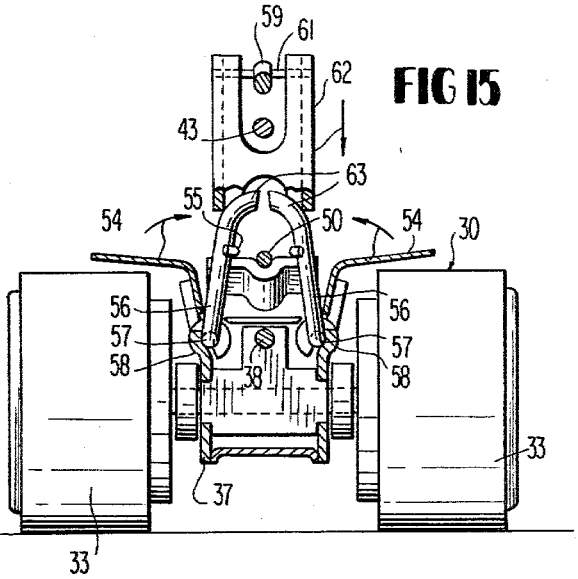
FIG. 15 is a similar view showing the fender brake means released.
Figure 16:
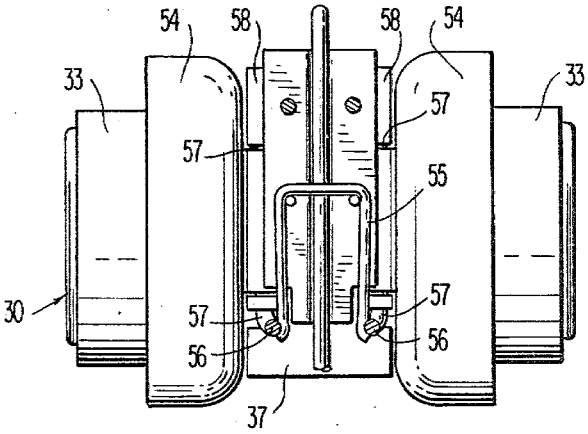
FIG. 16 is a horizontal section taken on line 16—16 of FIG. 14.
Figure 17:
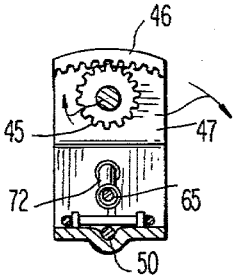
FIG. 17 is a fragmentary vertical section taken on line 17—17 of FIG. 6.

The maneuver assembly 30 also possesses fender brake elements 54 for the wheels 33 which are biased in active braking positions, FIG. 14, by the action of an expanding U-spring 55, FIG. 16, on rising arm extensions 56 of fender brake rocker shafts 57, which are rotatable in bearings 58 on the opposite sides of frame 37. A brake lever 59 near and below the maneuver handle 42 is rockably mounted in a slot 60 of the post 41 and pivotally connected at 61 to the top of a brake release vertical slide 62 which is forced downwardly by forward rocking of the lever 59 in the direction of the arrow, FIG. 6. The side walls of slide 62 straddle the top curved shoulders 63 of rising extensions 56 so as to cam the shoulders together as shown in FIG. 15 for raising the fender brake elements 54 to their release positions above the wheels 33. The fender brake elements are fixedly secured to and turn with the two rocker shafts 57 in response to lifting of the rockable lever 59. As stated, the spring 55 biases fender brake elements 54 to their active positions in FIG. 14 so that the player operated apparatus unit is normally under the influence of the friction brakes in any given position on the playing course until the lever 59 is raised to release the brakes.

Figure 12:
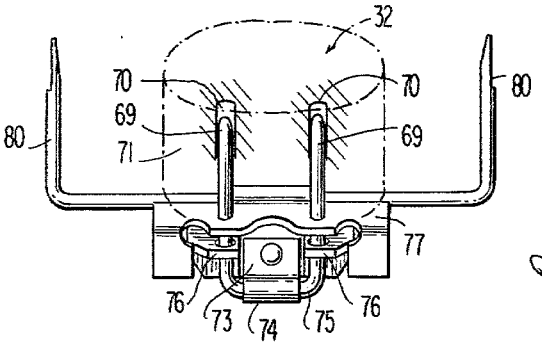
FIG. 12 is a fragmentary section taken on line 12—12 of FIG. 1.

The maneuver assembly 30 additionally comprises a fore and aft shiftable coupler knob 64 to permit the ready mounting and demounting of the golfing figure 32, or astronaut, onto the maneuver assembly. The knob 64 is attached to the rear end of a pull shaft 65 which operates through an opening 66 of post 41 and is biased forwardly by an expansion spring 67, FIG. 13. The forward headed end of pull shaft 65 is coupled through an extension link 68 with a pair of spaced parallel inclined coupling pins 69 which are received releasably in socket openings 70, FIG. 12, formed in the bottom of the leg and hip section 71 of golfing figure 32. The extension link 68 moves through a slot 72 in the frame 47 and carries at its forward end a short depending plate 73 rigid therewith terminating at its lower end in a knuckle 74 rotatably receiving a transverse connecting bar 75 of coupling pins 69. Ahead of the knuckle 74, the coupling pins 69 ride loosely in guide openings of fixed guide extensions 76 carried by frame 47. A bracket plate 77 is fixed rigidly to the coupling pins 69 ahead of guide extensions 76 and includes a knuckle 78 which tightly holds a cross shaft 79 of a pair of tilt indicator arms 80 at the opposite sides of the unit which coact with tilt indicator scales 81 on the opposite sides of the actuator assembly 31. The arms or pointers 80 indicate on the scales 81 the relative tilting of the golfing figure 32 under control of a tilt adjustment, yet to be described. The spring 67 serves to bias the coupling pins 69 to a position where the supported figure 32 is held normally in driven coupled relationship with a drive gear of the actuator assembly 31, as will be described.

Figure 13:
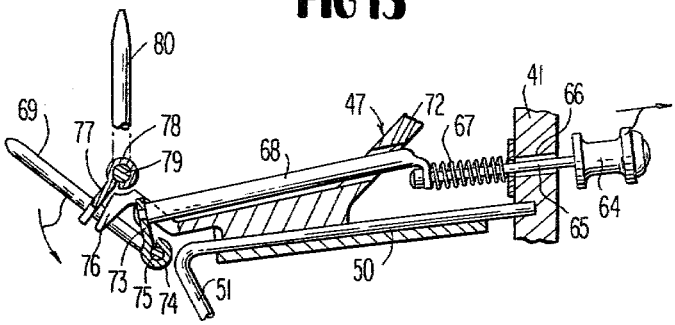
FIG. 13 is an enlarged fragmentary cross section taken through a figure coupling mechanism and operating knob.

When the knob 64 is pulled rearwardly against the force of spring 67, the reaction of the coupler pins 69 in the fixed guides 76 and their pivotal connection at 75 with fixed knuckles 74 causes them to swing downwardly and forwardly or counterclockwise in FIG. 13 about the knuckles 74 to almost level positions where the figure 32 is separated from its normal driven engagement with the assembly 31 and can be lifted free of the apparatus unit. Thus, the arrangement allows the figure 32 to be easily mounted and demounted at required times.

The maneuver assembly 30 also carries at its opposite sides and above the wheels 33 a pair of playing club cylindrical containers or holders 82 for right and left hand playing clubs 83 whose head shapes may vary generally in the manner of a regular set of golf clubs. At least six basic clubs will be furnished in the two containers 82. For appearance sake, the containers 82 are made to resemble rockets for compatibility with the astronaut golfer theme. Each container 82 has club identifying indicia 84 on its periphery viewable through an aperture 85 in a fixed mounting band 86 for each container. The heads of clubs 83 project radially through slots 87 at the rear of each container 82. A rotational ring 88 at the rear of each club container has a single slot 89 for registry with one of the slots 87 whereby a selected club may be withdrawn for use while the other clubs remain locked in place by the ring 88.

Figure 2:
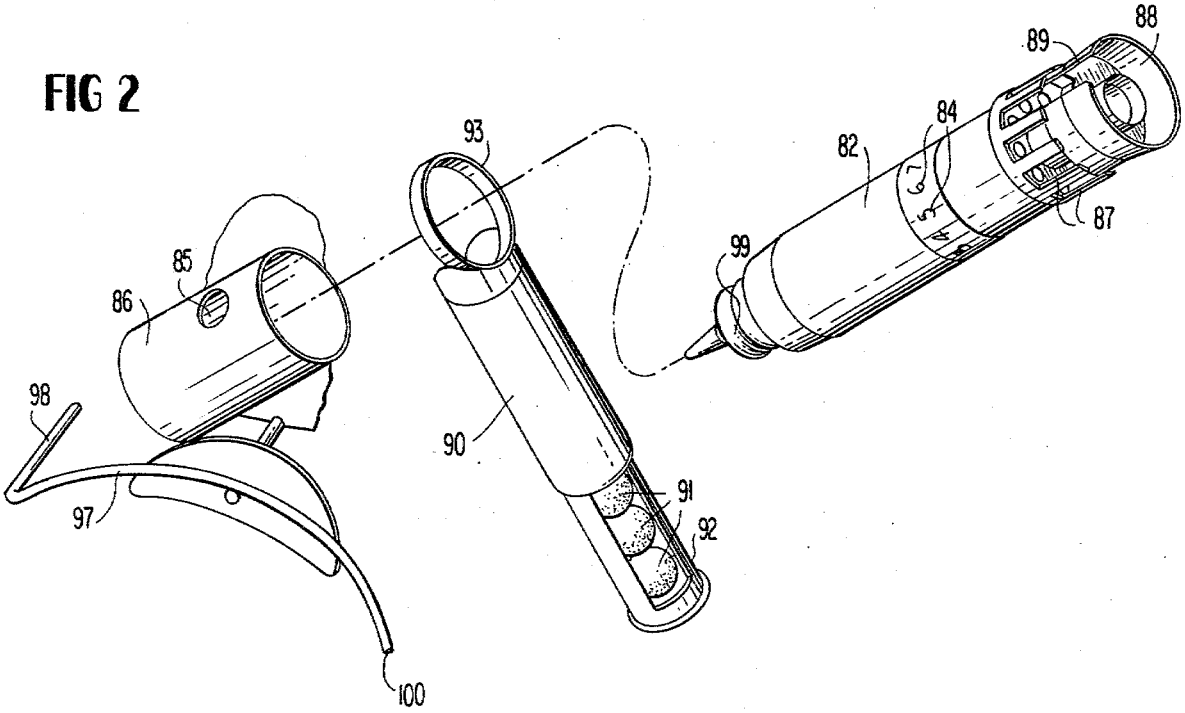
FIG. 2 is a fragmentary exploded perspective view of a club holder and associated ball container.
Figure 4:
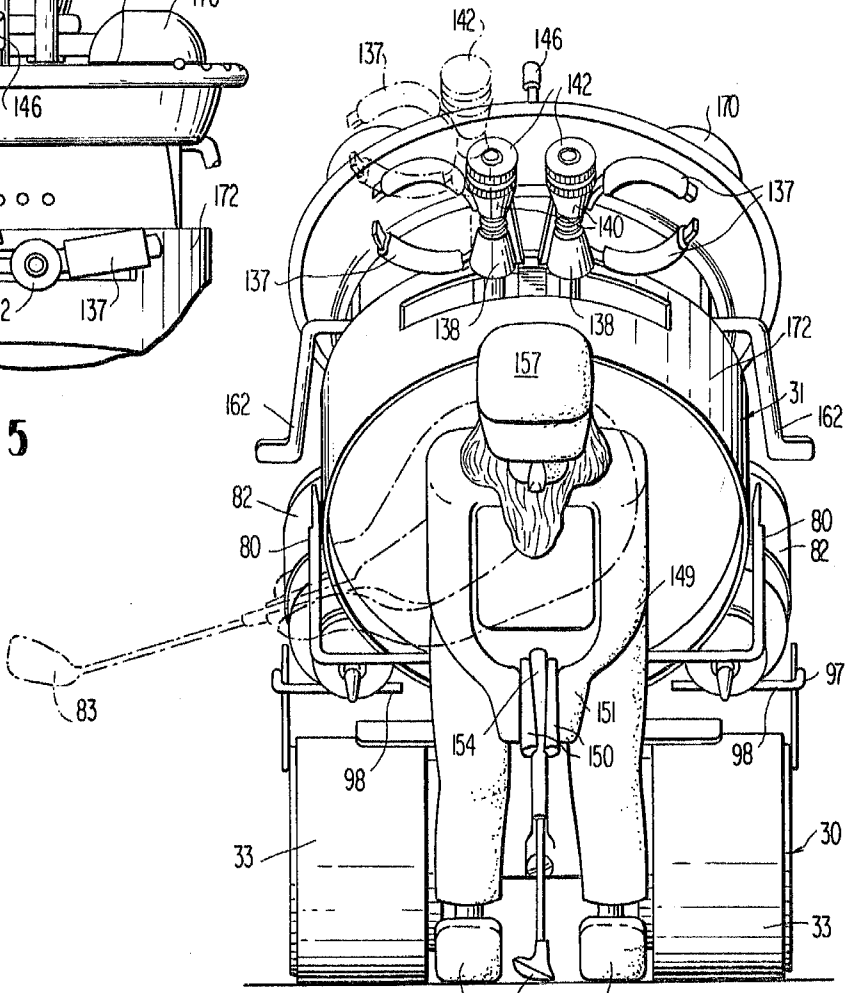
FIG. 4 is a front elevational view of the apparatus unit.
Figure 5:
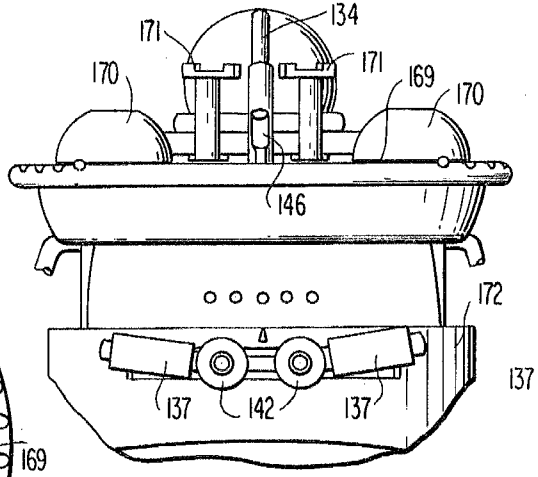
FIG. 5 is a fragmentary elevational view taken in the direction of the arrow 5 in FIG. 1.

Associated with each container 82 and depending therefrom at right angles, FIG. 1, is a cylindrical supply tank 90 for game playing balls 91 of very lightweight material, such as styrofoam. Preferably, the balls measure about ⅜ths of an inch in diameter but their size may be varied somewhat under the invention. The lightweight balls may also be constructed like table tennis balls but in the required diameter. It is essential to the proper playing of the game that a very lightweight ball be employed regardless of its material. A styrofoam ball of the proper diameter is quite satisfactory. The balls 91 are held within a slotted telescoping dispensing tube 92 of the tank 90, as shown in FIG. 2. Each tank 90 may be suspended from the club container 82 by a suspension ring 93. The two suspension rings are carried by a transverse connecting hoursing 94 which includes a yaw meter scale 95 at its top to coact with a pointer 96 above this scale moving with the assembly 31 under influence of the yaw knob 44. The entire assembly consisting of the housing 94, the two containers 82 and ball tanks 90 are held in assembled relationship on the maneuver assembly 30 by a spring 97 having forward arms 98 which interlock with grooves 99 of the club containers 82. The rear transverse bar 100 of the spring 97 is anchored to an apertured post 101 on the rear of post 41 near the bottom of the same. The curved side arms of spring 97 bear on fixed pins 102 projecting from the opposite sides of housing 94.

The actuator assembly 31 forming the heart of the invention contains the mechanism for driving the rotational mid-section 103 of the golfing figure 32 so that one of the balls 91 may be struck by one of the clubs 83 with proper force for driving, putting or making iron shots in the game resembling golf. The assembly 31 having the previously-mentioned frame 47 includes an inclined axis elongated driving gear 104 mounted on a rotary shaft 105 carrying at its forward end a shorter drive gear 106. The shaft 105 is journaled in a bearing structure 107 of the frame 47.

For the purpose of tilting the figure 32 or astronaut on the rotational axis of the knuckles 74 at proper times, a rotational tilt knob 108 is provided at the rear of assembly 31 and is coupled through a driving spring 109, FIG. 20, to a washer 110 keyed to a screw shaft 111 having its forward end contacting the rear end of shaft 105 which is free to slide axially through a bore of drive gear 104 while remaining positively keyed thereto, FIG. 11. The forward end of shaft 105 bears directly on a rectangular spine pin 112 of the figure 32 so that forward displacement of the shaft 105 by knob 108 will tilt the figure 32 forwardly. The biasing spring 67 on coupler knob 64 will bias the figure 32 rearwardly to maintain contact between the shaft 105 and spine pin 112 at all times. The screw shaft 111 is held in a threaded extension 113 of a bracket 114 rigid with the main frame 47, FIG. 6. Closely beneath the drive gear 106, a fixed anchor pin 115 on the frame 47 engages through an apertured plate 116 at the rear of lower portion 71 of the figure 32 to prevent rotation of the golfing figure around the axis of gear 106.

Figure 9:
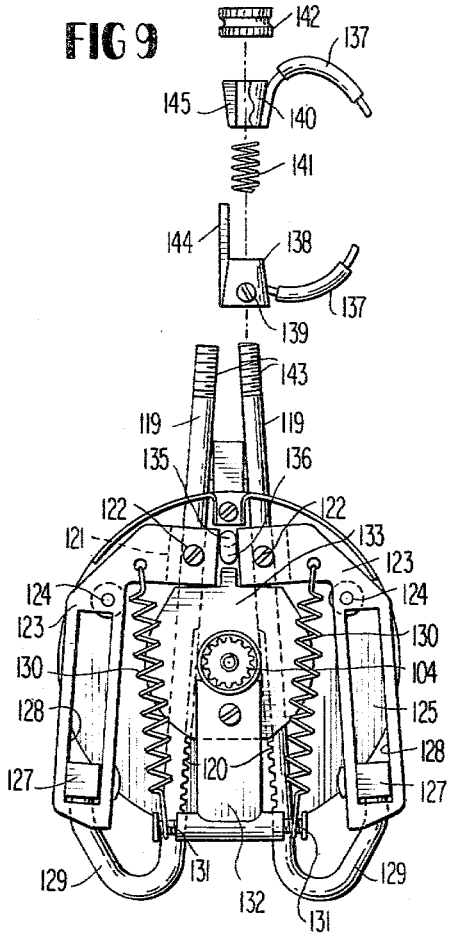
FIG. 9 is a vertical section taken on line 9—9 of FIG. 7 with both finger power operators in a neutral mode.

The gear 104 is restrained against axial movement with shaft 105 by a spring 117, FIG. 6, engaged with parts 118 of the main frame 47. The elongated gear 104 is driven in a power mode at proper times by either of two right and left hand finger operated rack bars 119, each having gear teeth 120 formed thereon. Each rack bar 119 is slidingly engaged through a bore of a block 121 attached at 122 to a slotted shifter link 123 pivoted at 124 to a swivel ring 125. Behind the swivel ring 125 is a stationary ring 126 formed rigidly with the frame 47. Slide blocks 127 engage guidingly in slots 128 of shifter links 123 and are secured to lower loop ends 129 of rack bars 119. Retractile springs 130 connected to the pivoted shifter links 123 inwardly of their pivots 124 bias the two links to a neutral position, FIG. 9, where the gear teeth 120 of both rack bars are separated from the gear 104. The lower ends of the two springs 130 are attached at 131 to a bracket 132 secured to a swivel 133 which turns as a unit with the previously mentioned swivel ring 125.

A turnable shift lever 134 is provided at the rear upper region of assembly 31 and secured to a cam shaft 135 having a shifter cam 136 secured to its forward end in eccentric relation to the shaft 135. The cam 136 engages between two upper blocks 121 and the cam extends vertically, FIG. 9, when the two rack bars 119 are in a neutral mode. By rotating the eccentric cam 136 in either of two directions by means of lever 134, either the right hand or left hand rack bar 119 may have its gear teeth 120 shifted into driving engagement with the gear 104, as shown in FIG. 11, while the other rack bar 119 is held out of engagement with the gear by its biasing spring 130. The mechanism enables a right handed or a left handed player to operate the drive gear 104 with convenience and comfort.

The upper end of each rack bar 119 is equipped with an adjustable size divided finger ring including sections 137. One of the sections 137 is attached to a sleeve 138 secured by a set screw 139 on one of the rack bars 119. The other ring section 137 is attached to a second sleeve 140 which engages over the rack bar with a compression spring 141 disposed between the opposing end faces of the two sleeves. A nut 142 is applied outwardly of the sleeve 140 and has engagement with screw threads 143 on the rack bar 119 whereby an adjustable finger size ring structure is established. A guide pin extension 144 on the sleeve 138 enters a guide slot 145 on the opposing sleeve 140 to prevent the latter from rotating when the nut 142 is turned.

A locking lever 146 to lock the yaw movement of the rack bars 119 with the swivel ring 125 and associated elements is provided at the top of the assembly 131 forwardly of the handle or lever 134. The lever 146 is attached to a sleeve 147 which surrounds the cam shaft 135 and allows the latter to turn freely therein. The forward end of sleeve 147 is fixed to the swivel ring 125 by screw-threads, FIG. 6, and tightening of the sleeve 147 by rotation of lever 146 will draw swivel ring 125 tightly against fixed ring 126 to thereby frictionally lock it against yaw rotation.

When the figure 32 is coupled to the maneuver assembly 30 in the described manner, an internal gear 148 attached to the bottom of rotary mid-section 103 is in mesh with the gear 106 at the forward end of shaft 105. The arms 149 of the golfing figure are attached to the revolving mid-section 103 and spring-urged club holding jaw elements 150 are attached to simulated hands 151 through a loose fitting cross pin 152. A biasing spring 153 spreads the rear ends of the jaws 150 and urges their forward ends together into gripping contact with the handle 154 of a club 83 placed therebetween. The club is easily removable for replacement by another club in the playing of the game by merely swinging the club shaft through an arc, as shown by the arrow in FIG. 6 to spread the gripping jaws 150.

When a player of the game depresses the engaged right or left hand rack bar 119 using the index finger within the adjustable size ring 137, the driving gear 104 causes rotation of gear 106 which in turn drives gear 148 causing the mid-section 103 to rotate on the axis of spine shaft 112 which is anchored at 155 to the leg and hip section of the golfing figure. With some practice, the golfing figure can be caused to strike the feather-weight ball 91 with the proper force to effect a drive, fairway iron shot or chip shot from a bunker or the like.

It can be mentioned here the golfing figure 32 is provided with self-adjusting and self-leveling feet 156 to further enhance the realistic nature of the game apparatus. An interesting feature of the apparatus shown particularly in FIGS. 6 and 18 through 19 is an arrangement whereby the head 157 of golfing figure 132 rotates in a natural follow-through mode when either the right hand or left hand rack bar 119 is finger-driven in the previously described manner to cause striking of the ball 91. The rotating mid-section 103 of figure 32 carries a head follow-through pin 158 extending at right angles to the spine pin 112 which is anchored in the lower section 71 of figure 32. The head 157 is attached to a sleeve 159 which rotates about the top of spine pin 112, FIG. 19, and is restrained in rotation by a spring 160 serving to return it to a neutral position shown in FIG. 18A where the head 157 is straight ahead. The rotatable sleeve 159 carries circumferentially spaced ribs 161 which are spaced circumferentially as shown in FIG. 18A. When the mid-section 103 rotates in the direction of the arrows, FIGS. 18A and 18B, the inner tip of follow-through pin 158 will engage one of the ribs 161 and push it along a circular path to thereby turn the sleeve 159 and head 157 in a realistic follow-through mode against the force of head return spring 160.

Figure 7:
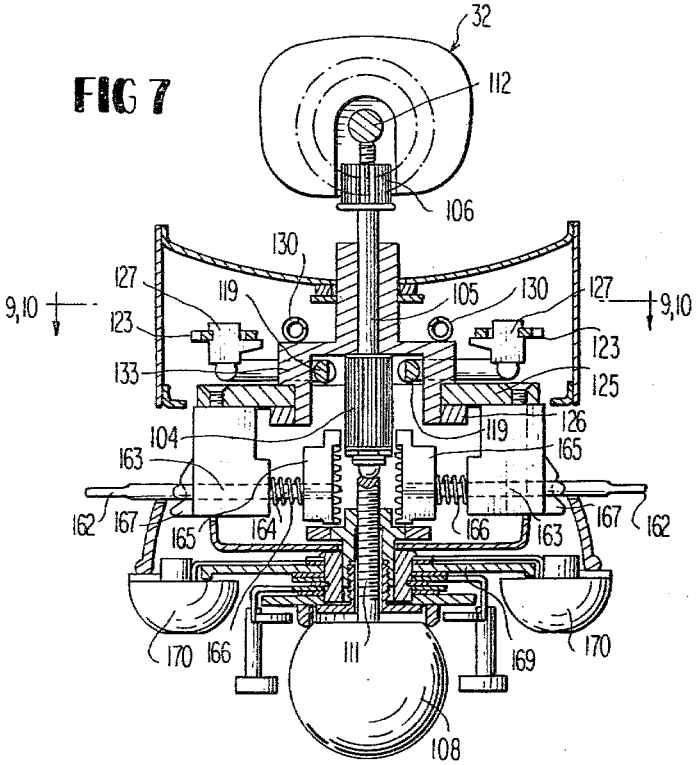
FIG. 7 is a cross section taken on line 7—7 of FIG. 6.
Figure 10:
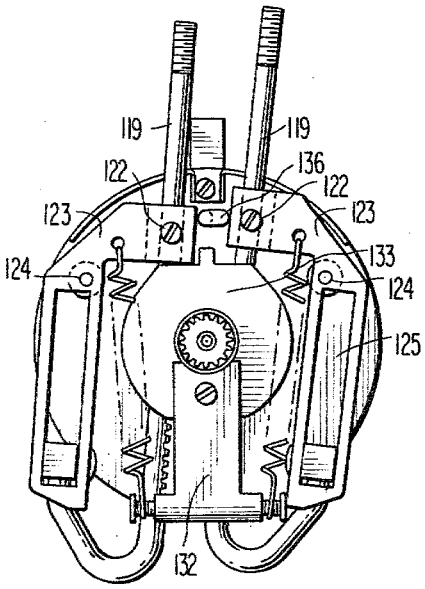
FIG. 10 is a similar view taken on line 10—10 of FIG. 7 with one finger operator in an engaged or active position and the other operator disengaged or inactive.

A further means on the actuator assembly 31 is provided to move the mid-section 103 and club 83 in a putting mode where a putter-type club 83 is engaged with the holding jaw elements 150. This means comprises on the assembly 31 right and left hand putting cranks 162 journaled in blocks 163 fixed to the rear of swivel or yaw ring 125. The opposing shafts 164 of putting cranks 162 have sector gears 165 carried by their inner ends and biased into mesh with the elongated drive gear 104 rearwardly of the rack bars 119, FIG. 7, by springs 166. The right and left hand putting crank drive gears 165 may be individually retracted and locked out of engagement with the drive gear 104 by retract and latch cams 167 on the outer sides of blocks 163. With this arrangement, both putting cranks 162 can be disabled during the operation of the selected rack bar 119 for driving or fairway shots. Similarly, when either putting crank 162 is actively engaged with the gear 104 for putting, the two rack bars 119 are retracted from the gear 104 in their neutral position, FIG. 9, under influence of springs 130.

Figure 3:
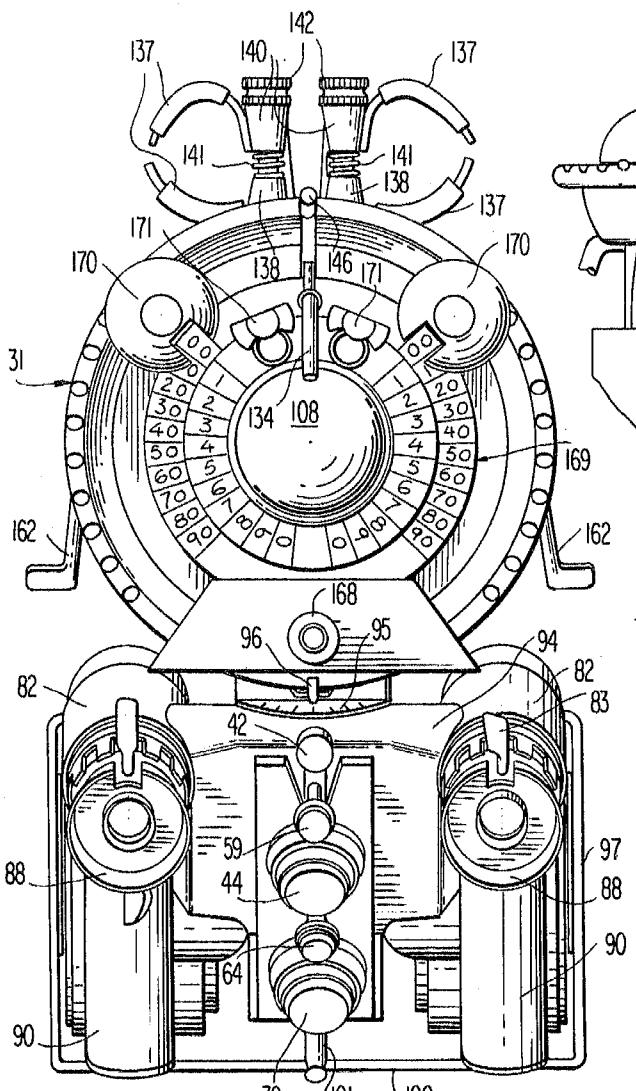
FIG. 3 is a rear elevation of the apparatus unit taken in the direction of the arrow 3 in FIG. 1.
Figure 8:
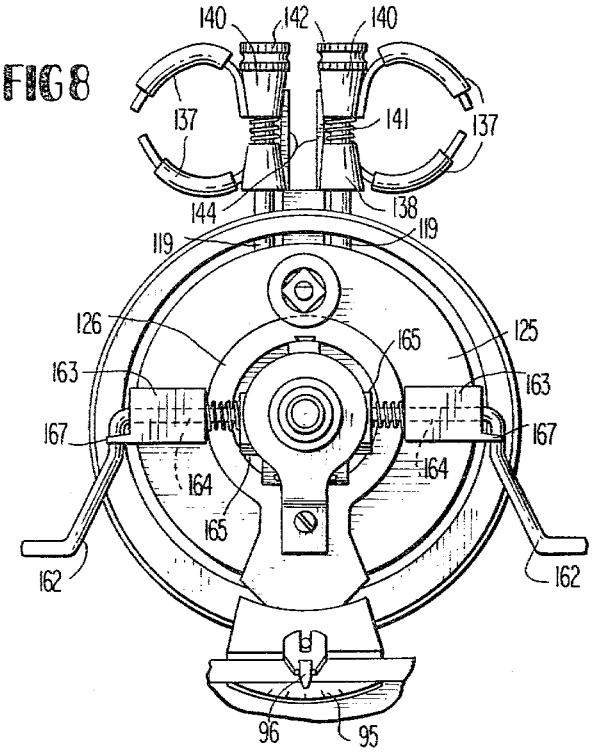
FIG. 8 is a fragmentary rear elevation taken on line 8—8 of FIG. 1.

A magnetically held iron ball marker 168 is carried by the assembly 31 to add further realism and interest to the golf-like game. A tally board 169 having right and left hand knobs 170 for the 10–100 scale and right and left hand knobs 171 for the 0–9 scale is provided, as best shown in FIG. 3. An external shell 172 for the assembly 31 is provided to impart to the apparatus unit a clean appearance.

Figure 22:
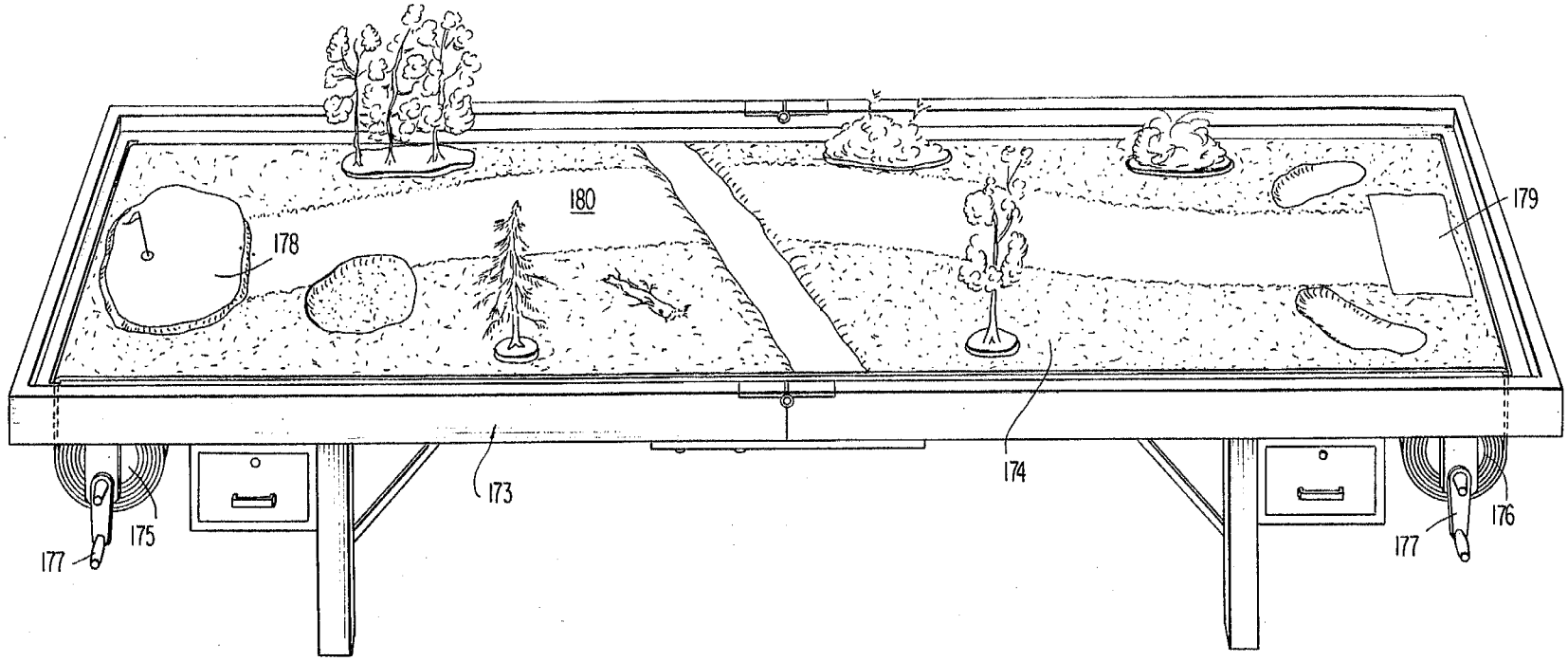
FIG. 22 is a perspective view of a game table and windable strip playing course utilized in connection with the player manipulated mobile apparatus unit.

FIG. 22 of the drawings shows one preferred type of game playing table 173 of the folding type having a flexible playing course web 174 of suitable fabric adapted to be wound and unwound from reels 175 and 176 equipped with hand cranks 177. The movable web 174 may have multiple golf playing greens 178, tees 179 and fairways 180 imprinted thereon or attached thereto, one typical golfing "hole" being shown in FIG. 22. Any suitable array of hazards may be included on each hole of the course, as illustrated. When the players complete each separate hole on the web 174, the web is advanced by cranks 177 to position the next hole layout in the play position on the table 173. Wide variations in the playing course can be utilized including such features as rebound abutments for the game ball, not shown, simulated cross wind producers on the side walls of the table and the like. The playing course may be made very realistic and challenging.

Each player, utilizing one of the described mobile apparatus units, maneuvers the same around the course by employing the rigid maneuver handle 42 of assembly 30 which can be tilted rearwardly to elevate the figure 32 during the wheeled maneuvering operations. At the time of the wheeled maneuvering, the brake lever 59 is of course elevated to release the fender brake elements 54, as described, and upon release of the lever 59, the brakes are set automatically to position the unit in a fixed location on the course.

The wheel base of the assembly 30 can be adjusted by rotation of the knob 39 to meet the needs and comfort and provide the desired balance in the unit for each player. The yaw of the entire assembly 31 and figure 32 relative to the assembly 30 is adjustable to suit the needs of individual players by the use of the yaw knob 44. Likewise, the tilt of the figure 32 may be adjusted as described by use of the knob 108. An independent yaw adjustment for both rack bars 119, putter cranks 162 and all associated parts attached to swivel ring 125 is provided. This adjustment may be locked by the lever 146 attached to the rotary locking sleeve 147, as described. The operation of the shifting cam lever 134 for rack bars 119 and the coupling knob 164 for figure 32 have already been fully described.

A game of skill is provided as well as a game of entertainment and interest for adults and mature youngsters in the home, private club or other entertainment facility. The uniqueness of the game apparatus reaches far beyond any known game now available.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An apparatus unit for use in playing an indoor game resembling golf comprising a wheeled maneuver assembly, an actuator assembly mounted on said wheeled maneuver assembly, cooperative means on said assemblies to adjust the yaw of the actuator assembly relative to the maneuver assembly, a golfing figure including a rotational club holding section and a base section, cooperative means on said maneuver assembly and golfing figure base section to releasably couple the golfing figure to the maneuver assembly, cooperative rotational drive means on the actuator assembly and golfing figure rotational section, and manually operated means on the actuator assembly to activate said rotational drive means.

2. An apparatus unit as defined in claim 1, and said wheeled maneuver assembly comprising a main frame, an axle on the main frame, a pair of wheels on said axle, and rotational screw-threaded means on the maneuver assembly for shifting said axle and said wheels in the fore and aft direction on said main frame of the maneuver assembly.

3. An apparatus unit as defined in claim 1, and said cooperative rotational drive means comprising a driving gear on said actuator assembly, a rotational drive shaft coupled with said driving gear, another gear carried by the drive shaft, a coacting gear secured to said rotational club holding section of the golfing figure, and selectively operable manual gear means on said actuator assembly to drive said driving gear and drive shaft in a power stroke mode and in a putting mode.

4. An apparatus unit as defined in claim 3, and said selectively operable manual gear means comprising shiftable right hand and left hand gear means.

5. An apparatus unit as defined in claim 3, and said selectively operable manual gear means comprising a rack bar adapted to drive said driving gear in said power stroke mode, means to shift the rack bar out of engagement with said driving gear, a sector gear adapted to drive said driving gear in a putting mode, and means to shift the sector gear out of engagement with said driving gear.

6. An apparatus unit as defined in claim 5, and said means to shift said rack bar including a rotary eccentric shifting cam on said actuator assembly and having a manual handle.

7. An apparatus unit as defined in claim 6, and a slotted shifting link for said rack bar pivotally mounted on said actuator assembly and being guidingly engaged with an extension of the rack bar, and a biasing spring connected with said slotted shifting link and urging it in one direction on its pivot to maintain the gear teeth of the rack bar separated from said driving gear.

8. An apparatus unit as defined in claim 7, and a companion pair of said rack bars, slotted shifting links and biasing springs disposed on opposite sides of said driving gear and drive shaft and being bodily mounted on a rotational swivel ring of said actuator assembly.

9. An apparatus unit as defined in claim 5, and said rack bar having an adjustable size finger engageable ring thereon.

10. An apparatus unit as defined in claim 5, and a swivel ring on said actuator assembly carrying said rack bar, rack bar shifting means, sector gear and sector gear shifting means whereby the yaw of such elements may be adjusted on the actuator assembly, and manual means to releasably lock the swivel ring in selected adjusted positions of yaw.

11. An apparatus unit as defined in claim 3, and a holding pin on said actuator assembly engaged within an aperture in the base section of the golfing figure to prevent rotation of said base section with said coacting gear.

12. An apparatus unit as defined in claim 3, and said rotational drive shaft, driving gear and second-named gear being coaxial on an inclined axis which diverges rearwardly from a horizontal plane through the wheel axis of said maneuver assembly.

13. An apparatus unit as defined in claim 12, and said golfing figure having a body portion axis at right angles to the drive shaft axis, the golfing figure including feet which can rest on a level supporting surface when the wheeled maneuver assembly is in a level condition.

14. An apparatus unit as defined by claim 3, and an adjustable rotational screw-threaded means on the actuator assembly engaging one end of the drive shaft for displacing it axially relative to the driving gear for adjusting the tilt of said golfing figure, said drive shaft being slidable through a bore of said driving gear and having its other end engaging a spine member within said golfing figure.

15. An apparatus unit as defined in claim 1, and a normally active brake for the wheels of said maneuver assembly on said assembly, and a manual brake release lever on said maneuver assembly.

16. An apparatus unit as defined in claim 15, and a steering handle for said maneuver assembly arranged adjacent to said brake release lever.

17. An apparatus unit as defined in claim 15, and said brake for said wheels comprising a pair of wheel fenders, spring means biasing said fenders against said wheels, and mechanism interconnecting said brake release lever with said fenders and operable to raise the fenders out of engagement with said wheels.

18. An apparatus unit as defined in claim 1, and said first-named cooperative means on said maneuver assembly comprising a reciprocatory coupling knob and spring biasing means, and pivotal coupling pins for the base section of said golfing figure operatively connected with said coupling knob, said base section having pin receiving sockets.

19. An apparatus unit as defined in claim 1, and said rotational club holding section including simulated arms and hands, and spring-urged club gripping jaws attached to said simulated hands.

20. An apparatus unit as defined in claim 1, and said golfing figure base section including self-adjusting simulated feet.

21. An apparatus unit as defined in claim 1, and said golfing figure further including a simulated head, means rotatably connecting said head with said base section including a spine pin anchored to the base section and a sleeve in said head rotatably engaged with the spine pin, the spine pin passing through said rotational club holding section, and resilient lost motion drive means on said rotational club holding section and said sleeve in said head whereby said head is driven in a natural follow-through mode whenever the rotational club holding section is driven in a right hand or left hand ball striking mode.

22. An apparatus unit as defined in claim 1, and holder means for plural simulated golf clubs and for playing balls on said maneuver unit.

23. An apparatus unit as defined in claim 1, and a rotational game score and hole number tally means on the rear of said actuator assembly.

24. An indoor game apparatus comprising a playing surface simulating a golf course having a series of golfing holes laid out thereon, a lightweight simulated golf ball to be stroked on said playing surface, and a player manipulated wheeled apparatus unit having a brake and a golfing figure including a rotational club holding section, and manually operable driving means for said rotational club holding section on said apparatus unit including separate means to drive the club holding section in a power swing mode and a putting mode.

25. An indoor game apparatus as defined in claim 18, and said ball being formed of lightweight plastic foam.

26. An indoor game apparatus as defined in claim 24, and said playing surface comprising an elongated movable web containing said series of golfing holes thereon, a supporting table surface for said web, and means to advance the web across the supporting table surface one hold at a time.

* * * * *